US005133101A

United States Patent [19]

Hauser et al.

[11] Patent Number: 5,133,101

[45] Date of Patent: Jul. 28, 1992

[54] HANDLE FOR A MOP

[76] Inventors: Scott Hauser; Gord Houston, both of 144 Deeridge Way SE., Calgary, T2J 5Y6, Canada

[21] Appl. No.: 685,194

[22] Filed: Apr. 15, 1991

[51] Int. Cl.[5] ..... A46B 5/02

[52] U.S. Cl. ..... 15/143.1; 15/229.2; 16/110 R; 56/DIG. 18; 294/57

[58] Field of Search ..... 15/143 R, 229.2, 229.6; 16/110 R, 114 R, 125, 127; 56/400.01, 400.04, 400.17, 400.18, DIG. 18; 81/489; 172/371; 294/57, 58

[56] References Cited

U.S. PATENT DOCUMENTS

| | | | |
|---|---|---|---|
| 85,956 | 1/1869 | Pinkham | 15/143 R |
| 186,254 | 1/1877 | Jackson | 15/143 R |
| 1,411,435 | 4/1922 | Hosmer | 294/58 |
| 2,244,585 | 6/1941 | Tweit | 15/143 R |
| 2,677,838 | 5/1954 | Jouban | 15/229.6 |
| 3,014,750 | 12/1961 | Briggs | 294/58 |
| 4,477,114 | 10/1984 | Callis | 294/58 |
| 4,704,758 | 11/1987 | Hoffman | 16/110 R |
| 4,809,388 | 3/1989 | Dietrich | 15/143 R |
| 4,930,181 | 6/1990 | Johnson | 16/110 R |
| 4,958,407 | 9/1990 | Johnson | 294/58 |

FOREIGN PATENT DOCUMENTS

| | | | |
|---|---|---|---|
| 803572 | 4/1951 | Fed. Rep. of Germany | 16/110 R |
| 3517538 | 11/1986 | Fed. Rep. of Germany | 15/143 R |

*Primary Examiner*—Harvey C. Hornsby
*Assistant Examiner*—Mark Spisich
*Attorney, Agent, or Firm*—Jerry T. Kearns

[57] ABSTRACT a mop includes a substantially straight cylindrical shaft having first and second opposite ends. A mop head is secured at the first end of the shaft, and a substantially cylindrical foam rubber first hand grip is received over the first end of the shaft. Two pairs of laterally extending, circumferentially aligned, axially spaced, converging struts extend from diametrically opposed locations on an intermediate portion of the shaft. A bearing member is secured between each pair of struts. A sleeve is mounted for rotation around each of the bearing members. A foam rubber hand grip is secured to each sleeve, providing second and third hand grips disposed at equal axial spacing and lateral offset with respect to the shaft, and mounted for rotation about axes substantially parallel to the longitudinal axis of the shaft. The inventive construction facilitates manipulation of the mop head without causing callousing to the hands, or strain to the wrists and forearms of the user.

4 Claims, 3 Drawing Sheets

HANDLE FOR A MOP

BACKGROUND OF THE INVENTION

1. Field of the Invention

The present invention relates to mops, and more particularly pertains to a mop having an ergonometric design to facilitate manipulation of the mop head without causing strain or injury to the user. Prolonged use of a conventional mop, for example by janitorial workers, causes callousing of the hands and strain to the wrist and forearms of the user. Use of a conventional mop requires rotation of the mop about the longitudinal axis of the mop handle shaft, in order to clean certain floor locations such as room corners, wash the mop head in a bucket, and wring water from the mop head. With conventional mops, a user must apply a fairly great torque directly to the shaft, resulting in strain of the wrists and forearms and callousing of the hands. These factors can also induce premature worker fatigue and result in a loss of productivity.

2. Description of the Prior Art

Various types of mops are known in the prior art which include various mechanisms for rotating the mop head to effect wringing of water from the mop head.

SUMMARY OF THE INVENTION

A representative embodiment of the concepts of the present invention is illustrated in the drawings and makes use of a mop including a substantially straight cylindrical shaft having first and second opposite ends. A mop head is secured at the first end of the shaft, and a substantially cylindrical foam rubber first hand grip is received over the first end of the shaft. Two pairs of laterally extending, circumferentially aligned, axially spaced, converging struts extend from diametrically opposed locations on an intermediate portion of the shaft. A bearing member is secured between each pair of struts. A sleeve is mounted for rotation around each of the bearing members. A foam rubber hand grip is secured to each sleeve, providing second and third hand grips disposed at equal axial spacing and lateral offset with respect to the shaft, and mounted for rotation about axes substantially parallel to the longitudinal axis of the shaft. The inventive construction facilitates manipulation of the mop head without causing callousing to the hands, or strain to the wrists and forearms of the user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mop constructed so as to minimize strain on the wrists and forearms of a user.

It is another object of the present invention to provide a new and improved mop constructed so as to minimize callousing of the hands of a user.

It is a further object of the present invention to provide a new and improved mop having three hand grips disposed so as to allow convenient rotation of a mop about the axes of the elongated handle shaft.

An even further object of the present invention is to provide a new and improved mop having rotatable offset hand grips to facilitate manipulation of the mop head by a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
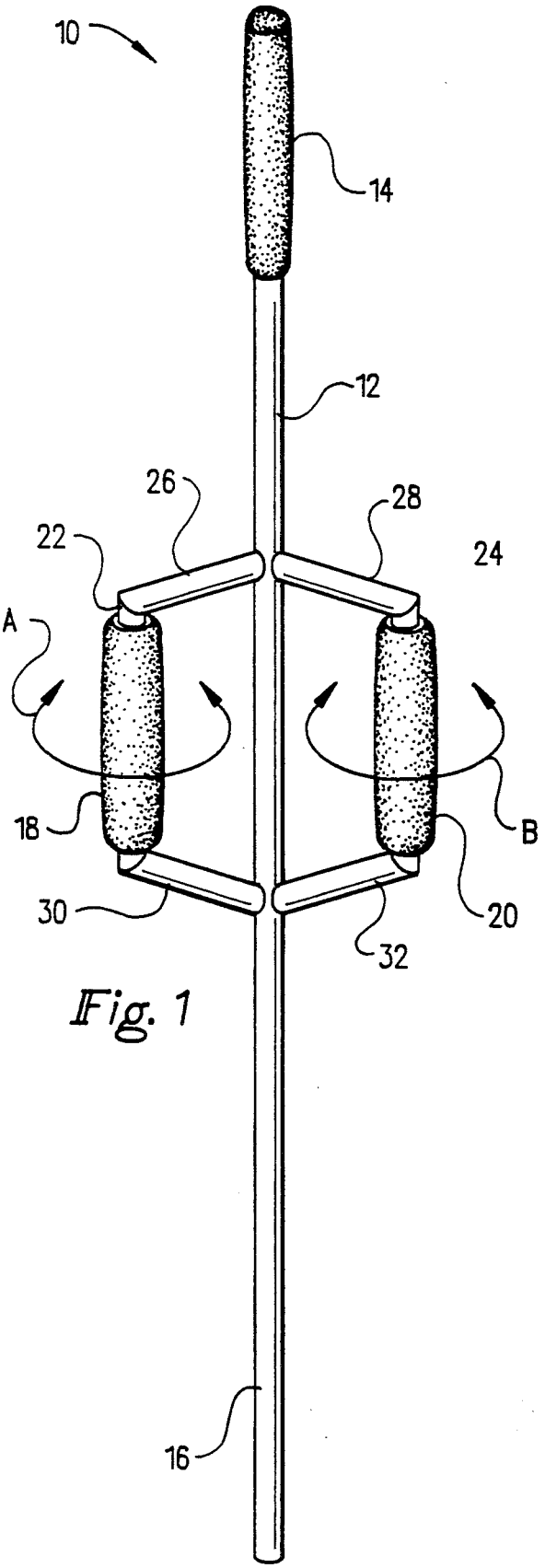
FIG. 1 is a front elevational view of a mop handle according to the present invention.

With reference now to the drawings, and in particular to FIG. 1 thereof, a new and improved mop embodying the principles and concepts of the present invention and generally designated by the reference numeral 10 will be described.

Figure 2:
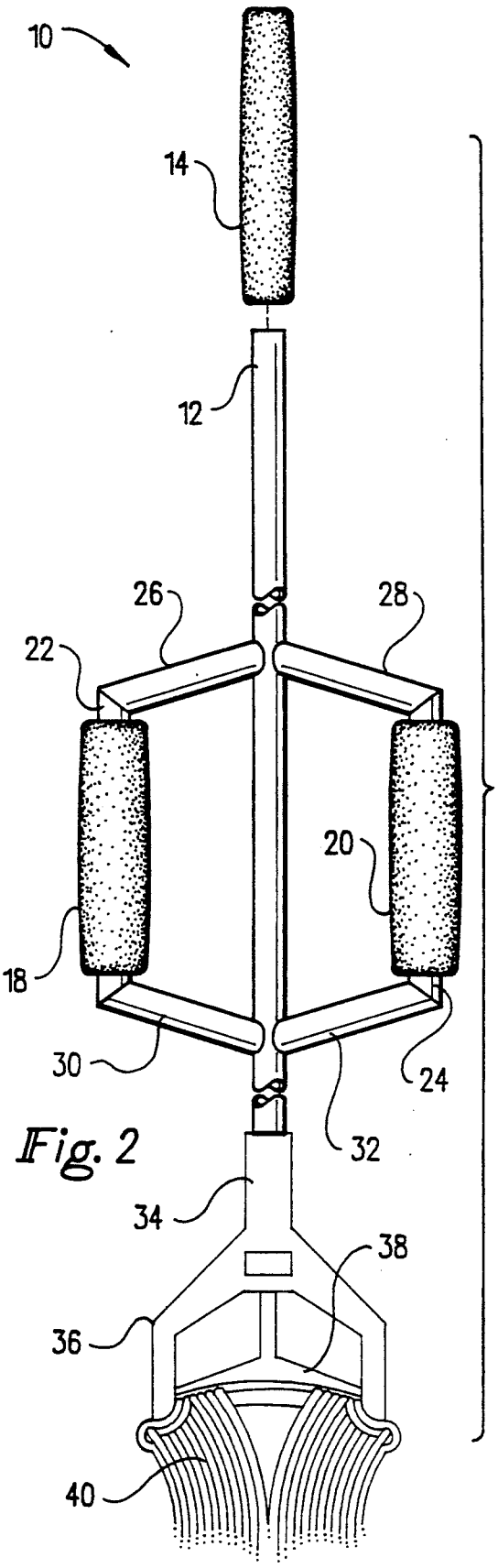
FIG. 2 is a front elevational view, partially cut away, of a mop according to the present invention.
Figure 3:
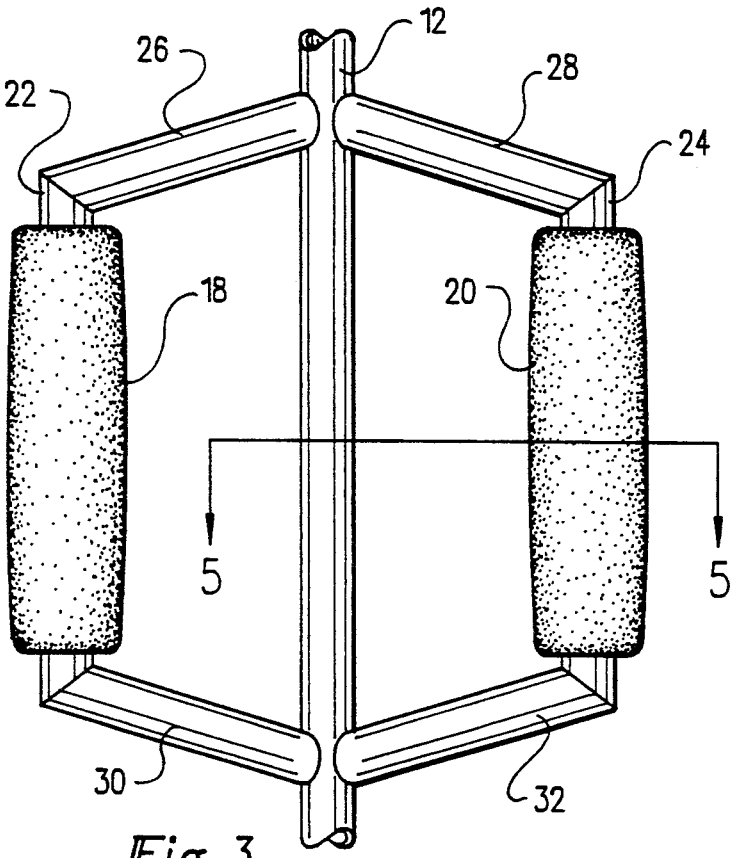
FIG. 3 is a detail view illustrating the second and third offset hand grips of the mop according to the present invention.
Figure 4:
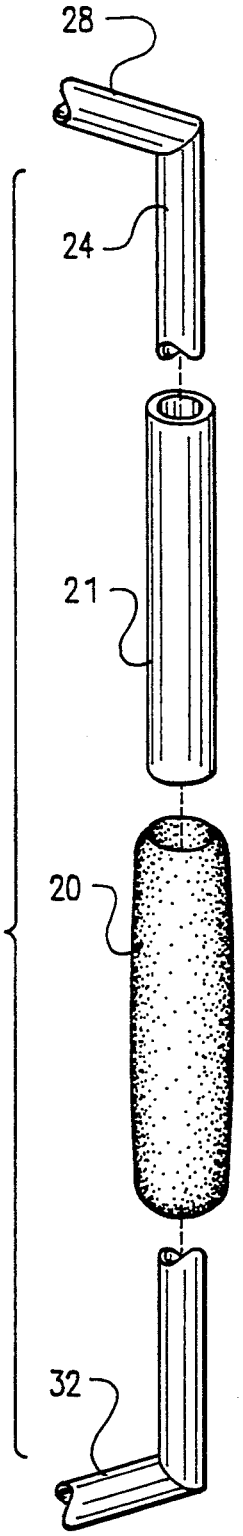
FIG. 4 is an exploded detail view illustrating the rotational mounting of the second and third hand grips of the mop according to the present invention.
Figure 5:
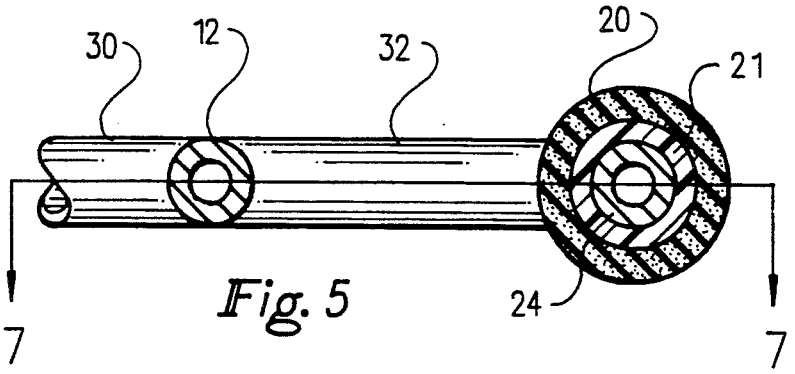
FIG. 5 is a transverse cross-sectional view, taken along line 5—5 of FIG. 3.
Figure 6:
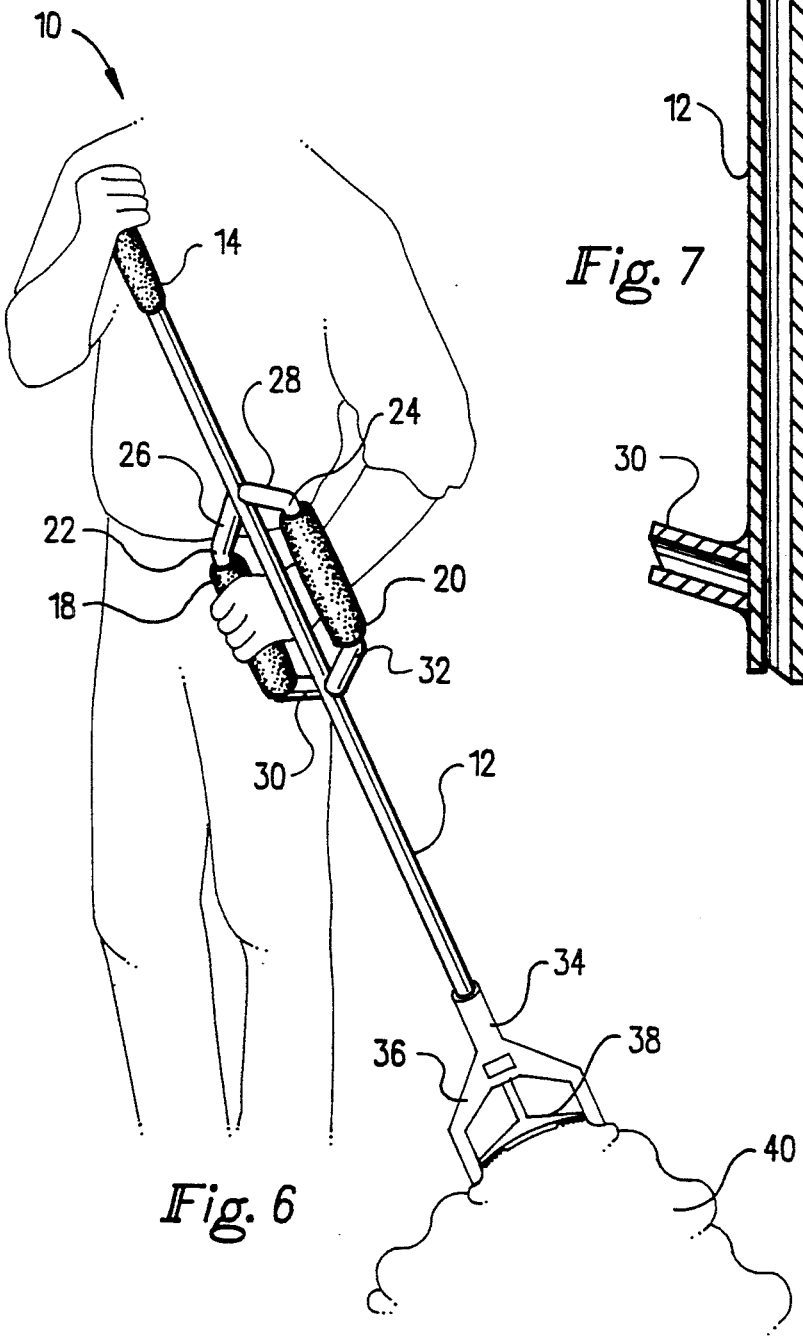
FIG. 6 is a perspective view illustrating the manner of use of the mop according to the present invention.
Figure 7:
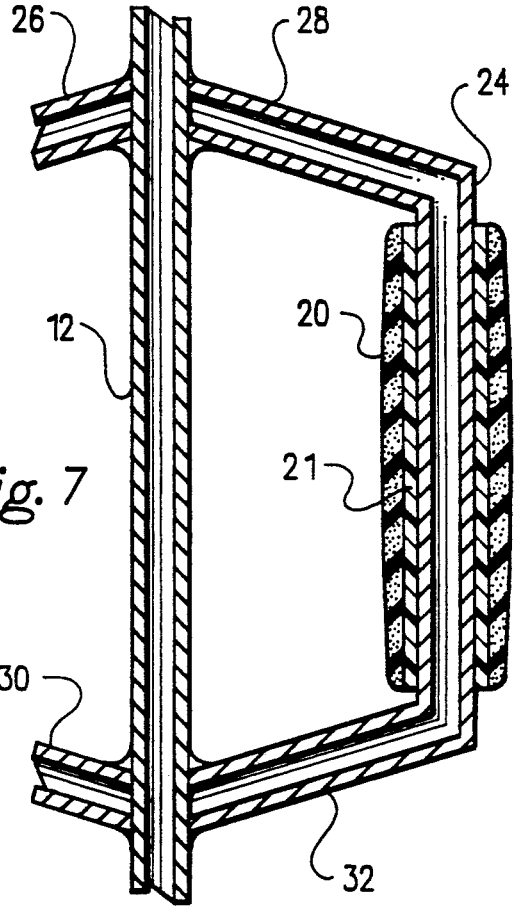
FIG. 7 is a longitudinal cross-sectional view, taken along line 7—7 of FIG. 5.

More specifically, it will be noted that the first embodiment 10 of the invention includes an elongated cylindrical shaft 12, having a length of about 50 to 52 inches and preferably constructed from aluminum tubing having an outer diameter of 1.0 inches and an inner diameter of $\frac{7}{8}$ inches. A first end 16 of the shaft 12 is adapted for securement to a mop head of conventional construction. A suitable type of mop head is illustrated in FIGS. 2 and 6 and includes a cylindrical socket 34 which receives the end 16 of the handle 12. A bifurcated body portion 34 includes a clamping mechanism 38 to secure a conventional swabbing element formed by absorbent fiber strands.

A first cylindrical foam rubber hand grip 14 is disposed over the second end of the shaft 12, and may be adhesively or otherwise secured in place. The hand grip 14 preferably has a closed upper end, such that the end of the handle 12 is padded.

A first pair of struts 26 and 30 extend laterally from an intermediate portion of the handle 12. A second pair of struts 28 and 32 extend from a diametrically opposite location on the shaft 12. The struts 26, 30 and 28, 32 are disposed in axially spaced, circumferentially aligned pairs. Struts 26, 30 and 28, 32 converge adjacent their radially outer ends. Bearing members 22 and 24 are mounted in spaced parallel relation between respective pairs of struts 26, 30 and 24, 32. Second 18 and third 20 foam rubber hand grips are mounted for rotation on the bearing members 22 and 24, as indicated by arrows A and B. The second 18 and third 20 hand grips are mounted in spaced, parallel relation, for rotation about axes parallel to the longitudinal axis of the shaft 12. The hand grips 18 and 20 are disposed at the same axial distance along the shaft 12, and have the same lateral offset from the central longitudinal axis of the shaft 12. Additionally the hand grips 18 and 20 are diametrically opposed with respect to the shaft 12, such that the shaft 12, struts 26, 30 and 28, 32, and hand grips 18 and 20 lie in a substantially common plane.

With reference to FIGS. 3–5 and 7, the rotational mounting of the hand grips 18 and 20 will now be described. As the mounting of the hand grip 18 is identical to that of hand grip 20, the following detailed description of the rotational mounting of the hand grip 20 will be sufficient to enable those of ordinary skill in the art to practice the invention. A nylon sleeve 21 is disposed around the bearing member 24 with sufficient clearance to allow free rotation of the sleeve 21. A foam rubber cylindrical hand grip 20 surrounds the sleeve 21 and rotates therewith. The hand grip 20 may be adhesively or otherwise secured to the sleeve 21, or may be in frictional engagement therewith.

As shown in FIG. 6, a user of the mop 10 grasps the first hand grip 14 in one hand, and one of the other hand grips 18 or 20 in the other hand. The lateral spacing of the hand grips 18 and 20 from the shaft 12 provides a moment arm which facilitates rotation of the mop head 36. During such rotation, the rotary mounting of the hand grips 18 and 20 with respect to the bearing members 22 and 24 prevents abrasion and callousing of the user's hands. An alternative method of utilizing the mop involves grasping the hand grips 18 and 20 in opposite hands, while the mop head 36 is immersed in a bucket of water. By an oscillating 180 degree rotary movement of his hands around the central longitudinal axis of the shaft 12, a user may effectively rinse the absorbent portion 40 of the mop 10.

The struts 26, 28, 30, 32 and bearing members 22 and 24 are preferably formed from an aluminum tubing of the same diameter as the shaft 12. These components may be secured through conventional techniques, such as welding. The junctures of the struts 26 and 28 with the shaft 12 are preferably spaced about 17 inches from the second end of the shaft 12 provided with the hand grip 14. The junctures of the struts 30 and 32 with the shaft 12 are preferably spaced about 24 inches from the first end 16 of the shaft 12. The struts 26, 28, 30 and 32 each have a preferred length of about 4 and $\frac{3}{4}$ inches. The bearing 22 and 24 members have a preferred length of about 7 and $\frac{1}{2}$ inches, and are spaced about 8 inches apart, measured in a direction perpendicular to the longitudinal axis of the shaft 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A mop handle, comprising:

an elongated substantially straight shaft having first and second opposite ends;

means for securing a mop head at said first end of said shaft;

a first hand grip disposed adjacent said second end of said shaft;

a second substantially straight hand grip extending substantially parallel to said shaft end secured at a portion of said shaft intermediate said first and second opposite ends and offset laterally with respect to a longitudinal axis of said shaft;

a third substantially straight hand grip secured extending substantially parallel to said straight shaft and at an intermediate portion of said shaft substantially diametrically opposed to said second hand grip and offset laterally with respect to said longitudinal axis; and means mounting said second and third hand grips for free about axes substantially parallel to said longitudinal axis.

2. A mop handle of claim 1, wherein said means mounting said second and third hand grips for rotation comprises:

a first elongated bearing member substantially rigidly secured at said intermediate portion of said shaft in parallel relation therewith and offset laterally with respect to said longitudinal axis of said shaft;

a first sleeve mounted for free rotation on said first bearing member;

said second hand grip disposed on said first sleeve for free rotation therewith;

a second elongated bearing member substantially rigidly secured at said intermediate portion of said shaft in parallel relation therewith and offset laterally with respect to said longitudinal axis of said shaft;

a second sleeve mounted for free rotation on said second bearing member; and said third hand grip disposed on said second sleeve for free rotation therewith.

3. The mop handle of claim 1, wherein said second and third hand grips are each substantially cylindrical.

4. A mop comprising:

an elongated. substantially straight cylindrical shaft having first and second opposite ends;

means securing a mop head at said first end of said shaft;

a first hand grip provided at said second end of said shaft, said first hand grip including a resilient padding material surrounding said shaft;

first and second struts extending laterally from a portion intermediate said first and second opposite ends of said shaft and converging in a common plane, said first and second struts secured at axially spaced circumferentially aligned locations on said shaft;

a first bearing member mounted between said first and second struts, said first bearing member extending in spaced substantially parallel relation with said shaft;

a first sleeve mounted for free rotation on said first bearing member;

a second hand grip disposed on said first sleeve for free rotation with said first sleeve about an axis substantially parallel to the longitudinal axis of said shaft;

third and fourth struts extending laterally from an intermediate portion of said shaft and converging in a common plane, said third and fourth struts secured at axially spaced circumferentially aligned locations on said shaft, said third and fourth struts extending from locations on said shaft substantially diametrically opposed to said first and second struts;

a second bearing member mounted between said third and fourth struts, said second bearing member extending in spaced substantially parallel relation with said shaft;

a second sleeve mounted for free rotation on said second bearing member; and a third hand grip disposed on said second sleeve for free rotation with said second sleeve about an axis substantially parallel to the longitudinal axis of said shaft, said second and third hand grips disposed at substantially the same axial position on said shaft and laterally offset substantially the same distance from said shaft.

* * * * *